US010371022B2

(12) United States Patent
Thai Thanh

(10) Patent No.: US 10,371,022 B2
(45) Date of Patent: Aug. 6, 2019

(54) VALVE APPARATUS HAVING SLOWLY REVOLVING ROTARY VALVES FOR INTERNAL COMBUSTION ENGINES

(71) Applicant: An Thai Thanh, Munich (DE)

(72) Inventor: An Thai Thanh, Munich (DE)

( * ) Notice: Subject to any disclaimer, the term of this patent is extended or adjusted under 35 U.S.C. 154(b) by 0 days.

(21) Appl. No.: 15/569,324

(22) PCT Filed: Apr. 20, 2016

(86) PCT No.: PCT/DE2016/000163

§ 371 (c)(1),
(2) Date: Oct. 25, 2017

(87) PCT Pub. No.: WO2016/173575

PCT Pub. Date: Nov. 3, 2016

(65) Prior Publication Data

US 2018/0051600 A1 Feb. 22, 2018

(30) Foreign Application Priority Data

Apr. 27, 2015 (DE) ..... 10 2015 005 316

(51) Int. Cl.
*F01L 7/04* (2006.01)

(52) U.S. Cl.
CPC ..... *F01L 7/045* (2013.01); *F01L 7/04* (2013.01)

(58) Field of Classification Search
CPC ..... F01L 7/045; F01L 7/04; F01L 7/02; F01L 7/00
See application file for complete search history.

(56) References Cited

U.S. PATENT DOCUMENTS 4,481,917 A * 11/1984 Rus ..... F01L 7/045 123/190.12

FOREIGN PATENT DOCUMENTS

| | | | |
|---|---|---|---|
| DE | 453633 | C | 12/1927 |
| DE | 102 39 403 | A1 | 4/2003 |
| EP | 0101431 | A2 | 2/1984 |
| EP | 1 788 218 | A2 | 5/2007 |
| FR | 422270 | A | 3/1911 |
| FR | 436844 | A | 4/1912 |

(Continued)

OTHER PUBLICATIONS

International Search Report of PCT/DE2016/000163, dated Sep. 29, 2016.

*Primary Examiner* — Jacob M Amick
(74) *Attorney, Agent, or Firm* — Collard & Roe, P.C.

(57) ABSTRACT

A valve system for internal combustion engines that is controlled by a camshaft is a potential source of engine damage if the timing thereof is disrupted (e.g. when the timing belts rupture). Furthermore, valves in combination with the camshaft and the timing chain contribute to noise and vibrations during operation. The production costs can be high. Thus, the engine is positioned higher and is heavier. Thus, there is proposed a valve mechanism composed of a plurality of gas exchange valves that revolve slowly about the cylinder wall. Each rotary valve is controlled separately and has symmetrical openings. The number of openings in the rotary valve corresponds to the number of working cycles per revolution. Since each rotary valve is driven separately and as a result of the size of the openings in the valve, it is possible to obtain different phase shifts, valve overlaps and opening times.

4 Claims, 4 Drawing Sheets

*Rotary valve with slanted section*

(56) References Cited

FOREIGN PATENT DOCUMENTS

| | | | |
|---|---|---|---|
| FR | 483896 | A | 8/1917 |
| FR | 32934 | E | 3/1928 |

* cited by examiner

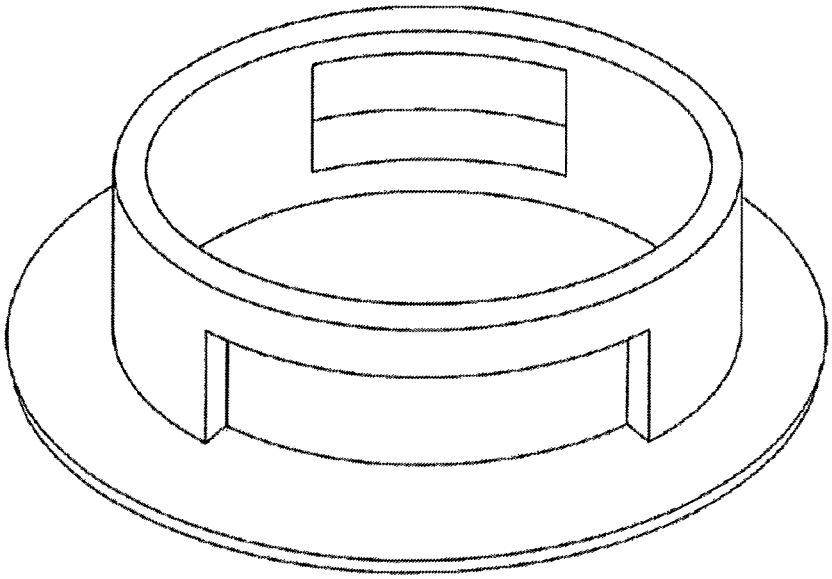
*Fig. 1: Rotary valve with two openings*
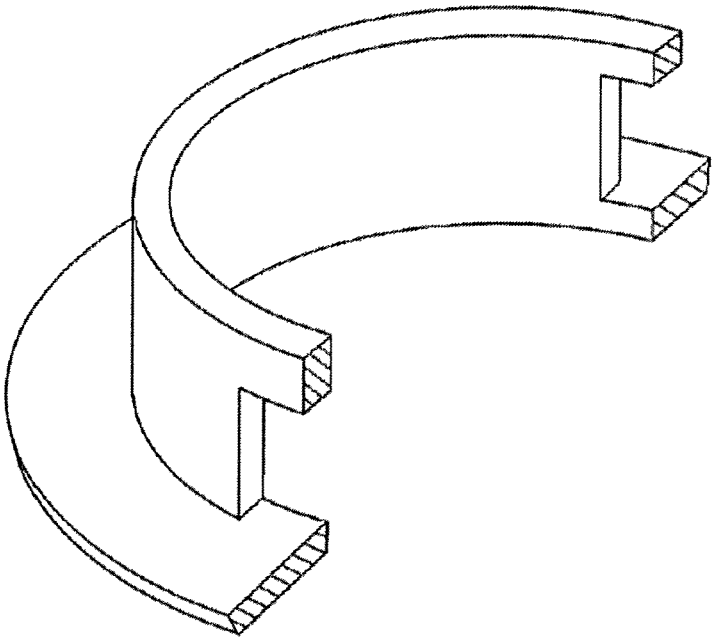
*Fig. 2: Cross-section of a rotary valve*

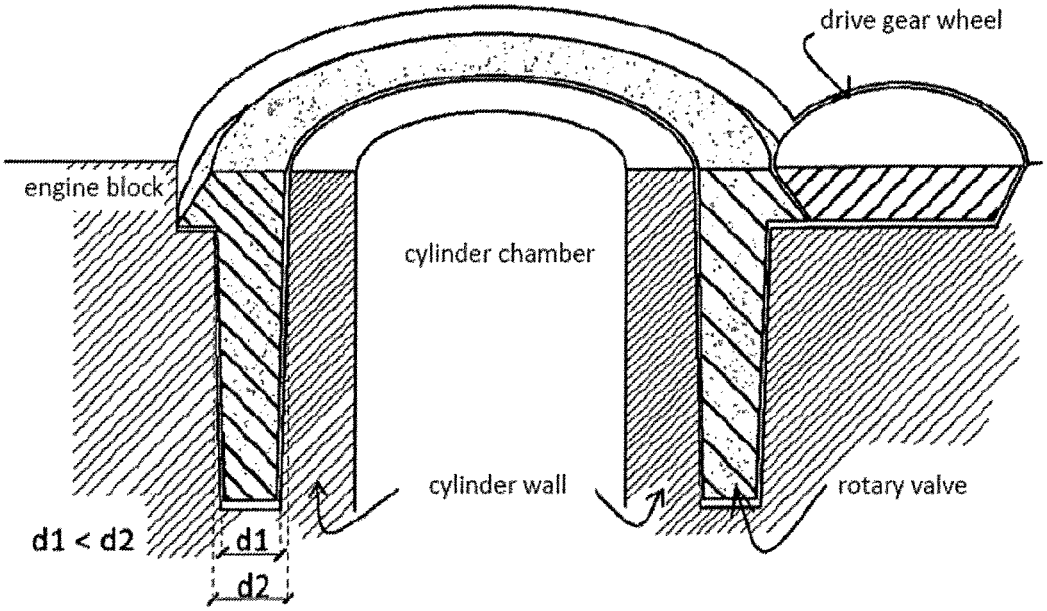
*Fig. 3: Rotary valve with slanted section*
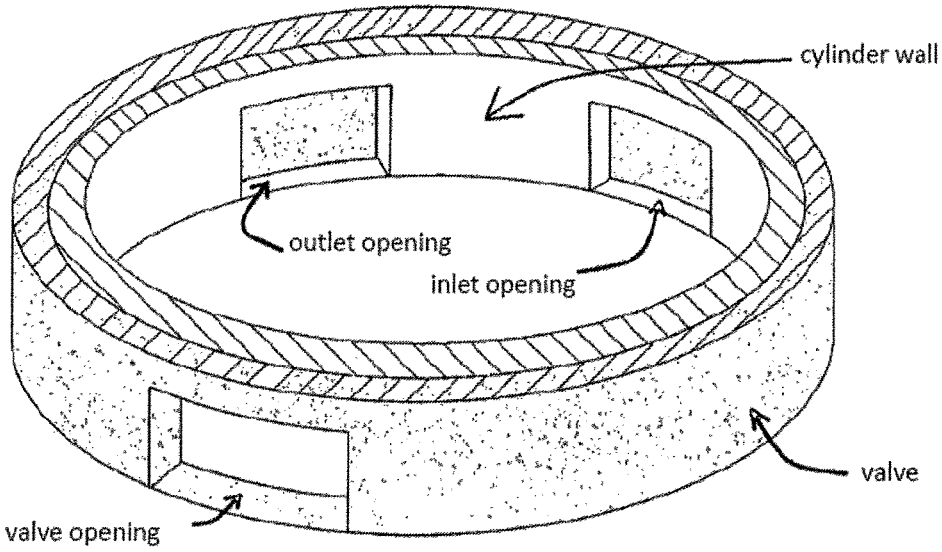
*Fig. 4: Cross-section of a valve and cylinder wall in the closed state*

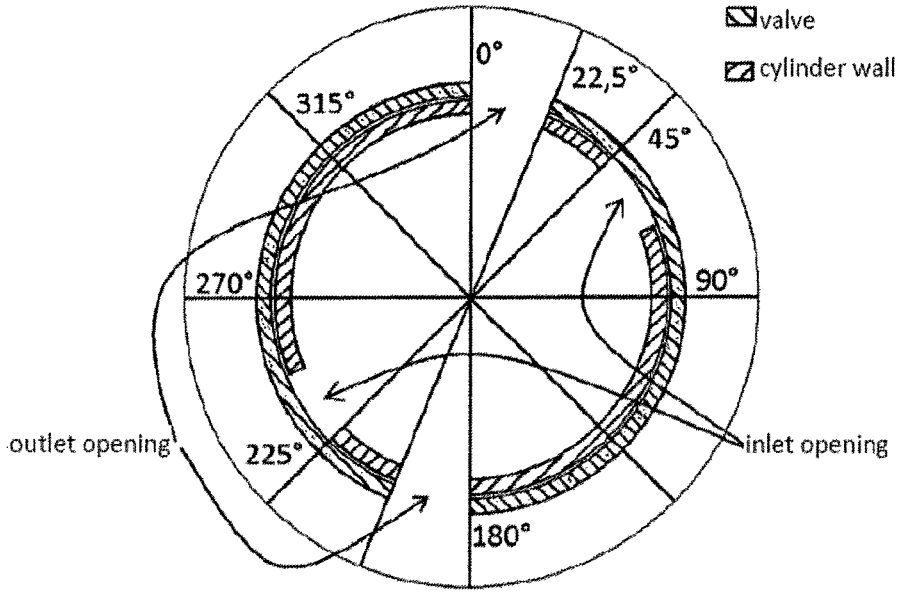
*Fig. 5: Cross-section of a rotary valve with 2 openings around a cylinder of a four-stroke engine*
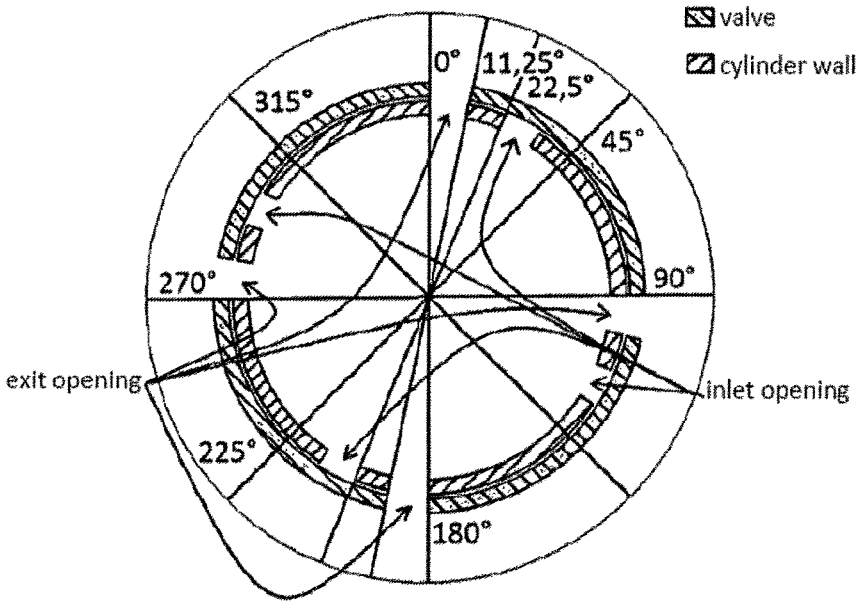
*Fig. 6: Cross-section of a rotary valve with 4 openings around a cylinder of a four-stroke engine*

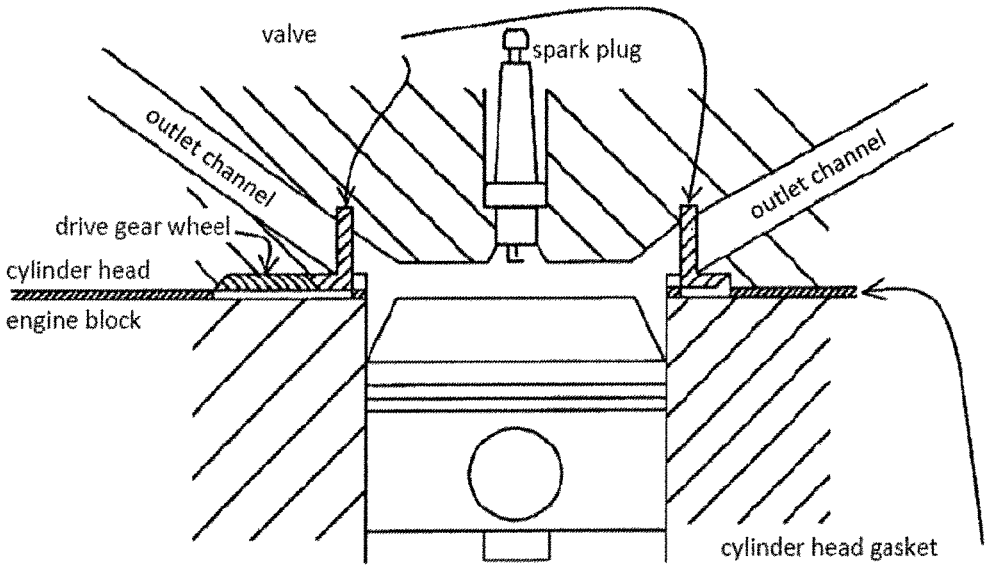
*Fig. 7: Cross-section of a four-stroke engine with an upper rotary valve*
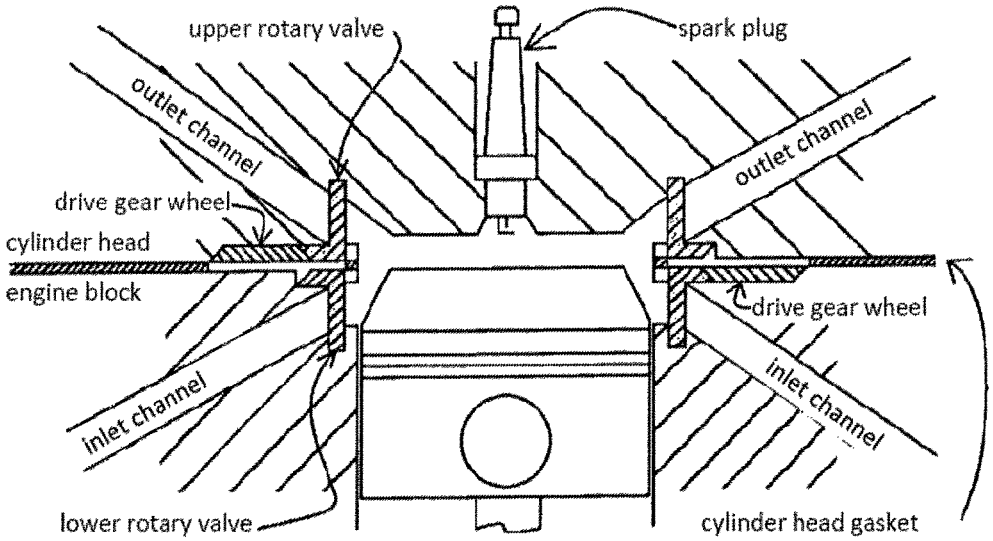
*Fig. 8: Cross-section of a four-stroke engine with a two-part (top and bottom) valve apparatus*

VALVE APPARATUS HAVING SLOWLY REVOLVING ROTARY VALVES FOR INTERNAL COMBUSTION ENGINES

CROSS REFERENCE TO RELATED APPLICATIONS

This application is the National Stage of PCT/DE2016/000163 filed on Apr. 20, 2016, which claims priority under 35 U.S.C. § 119 of German Application No. 10 2015005316.7 filed on Apr. 27, 2015, the disclosures of which are incorporated by reference. The international application under PCT article 21(2) was not published in English.

It is known that a valve for internal combustion engines, controlled by a camshaft, represents a possible source of engine damage if its timing control is disrupted (for example due to the V-belts being torn off). Valves in combination with camshaft and control chain are part of a cause of noise and vibrations in ongoing operation. The production costs for this conventional type of valve and its control mechanism are high. Because of the design including a camshaft, the engine is taller and heavier.

The invention indicated in claims 4, 5 and 6 is based on this problem of a valve apparatus consisting of compact and easy to produce rotary valves. It does not cause any engine damage of the type as in the case of valves having camshafts, in the event that the controller does not function properly. It saves energy for a drive and, at the same time, vibration, noise, and construction, height of an internal combustion engine are reduced.

All of the aforementioned problems of a conventional valve are solved by means of all the characteristics listed in the claims (possibly literal citation of the characteristics).

The advantages achieved with the invention particularly consist in that such a valve apparatus can be produced by means of few and compact components. An internal combustion engine that uses this valve apparatus is lower, lighter, simpler, more quiet, low in vibrations, easy to service and faster to install, by means of avoiding the usual camshaft design.

FIG. 1 is a perspective view of a rotary valve with two openings

FIG. 2 is a cross-sectional perspective view of a rotary valve

FIG. 3 is a cross-sectional view of a rotary valve with a slanted section

FIG. 4 is a cross-sectional view of a rotary valve and cylinder wall in a closed state FIG. 5 is a top cross-sectional view of a rotary valve with two openings around a cylinder of a four stroke engine FIG. 6 is a cross-sectional view of a rotary valve with four openings around a cylinder of a four stroke engine FIG. 7 is a cross-sectional view of a four stroke engine with an upper rotary valve FIG. 8 is a cross-sectional view of a four stroke engine with a two-part (top and bottom) valve apparatus.

The invention relates to a rotary valve (FIG. 1), which has symmetrically arranged openings on the side, at equal intervals. As a result, the rotary valve has a center of gravity that lies on its axis of rotation. Furthermore, the pressure difference in a total work cycle only maximally brings about an axially resulting force along the axis of rotation, because inlet openings (and outlet openings) of the cylinders also have a symmetrical arrangement. These factors prevent an imbalance during operation of a rotary valve.

The invention relates to a method for operation of an internal combustion engine having a valve apparatus, in which one or more rotary valves are used on the outside, around the cylinder wall, and its/their axis of rotation runs parallel to the cylinder axis (FIG. 4).

The possibility exists of combining different openings of the cylinders and of the rotary valve. For example: a) A cylinder only has outlet openings to an upper rotary valve and inlet openings to a lower valve (FIG. 8). Or b) a cylinder having inlet and outlet openings in pairs into only an (upper) rotary valve (FIG. 5, FIG. 6).

The inner wall of the rotary valve, together with the outer wall of the cylinders, forms a sliding surface by means of its common, identically running surface. This sliding surface is not precisely parallel to the axis of rotation, but rather slightly conical, so that the rotary valve does not become jammed in place due to the different heat expansion (FIG. 3). This angle is furthermore kept small, so that only a low axial press-down force is sufficient to hold the rotary valve in its seat, even if the pressure difference between the inside and the outside reaches a maximum. The same principle of the slightly conical construction is also used for the outer wall of the rotary valve and for the inlet/outlet channels.

The opening angle of the valve or of the cylinder can be increased or reduced in size by means of the design, in order to implement different opening periods for the gas exchange.

The possibility exists of increasing the number of openings of the rotary valve (FIG. 5, FIG. 6), in order to reduce its speed of rotation during operation. The number of openings of a rotary valve corresponds to the number of work cycles performed at a full revolution (360°). This means that the rotary valve has the factor 1/n relative to the work cycle of an engine, wherein n is the number of openings of a rotary valve. For example: In the case of a four-stroke engine, in which each work cycle requires two crankshaft revolutions, a rotary valve slows down by a factor of 1/(2*n) relative to the crankshaft. A rotary valve having four openings in a four-stroke engine therefore requires only one revolution, if the crankshaft rotates eight times (FIG. 6).

By means of a valve apparatus that has multiple (in FIG. 8 two) rotary valves that are controlled separately from one another, a phase shift of the inlet and outlet time can be implemented (for example by means of a valve drive using cylindrical gear wheels having a helical gearing).

The invention claimed is:

1. A valve apparatus for an internal combustion engine, comprising:

a cylinder wall;

a piston having a dead point;

at least two independent ring-like rotary valves, a plurality of valve seats;

wherein said rotary valves rotate in contact-free manner against one another, about their axis, which is the same as a cylinder axis, and sit lined up one on top of the other on an outside around said cylinder wall, above the top dead point of the piston, wherein the rotary valves and valve seats have openings disposed symmetrically relative to the axis of rotation, and an inner wall of the rotary valve and an outer wall of the cylinder form a lateral sliding surface, wherein the inner wall of the rotary valve and the outer wall of the cylinder are not parallel to the axis of rotation, thus forming a conically shaped rotary valve, and the speed of rotation of each rotary valve for a work cycle can be slowed down by means of increasing the number of openings, and wherein the rotary valves are controlled separately from one another, in order to implement a phase shift.

2. Valve apparatus for an internal combustion engine, having a cylinder having a cylinder wall and a piston having a top dead point, wherein the valve apparatus comprises:

a ring-like rotary valve, which rotates about its axis, which is the same as a cylinder axis, and sits on an outside around a cylinder wall above a top dead point of a piston, wherein the rotary valve and valve seat have openings disposed symmetrically relative to the axis of rotation, and an inner wall of the rotary valve and an outer wall of the cylinder form a lateral sliding surface, wherein the inner wall of the rotary valve and the outer wall of the cylinder are not parallel to the axis of rotation, thus forming a conically shaped rotary valve, and the speed of rotation of the rotary valve for a work cycle can be slowed down by means of increasing the number of openings.

3. Rotary valve that has a ring-like shape, lateral openings disposed symmetrically relative to the axis of rotation, a conically shaped section on the entire lateral slide surfaces, and is used in a valve apparatus like that in claim 1.

4. Rotary valve that has a ring-like shape, lateral openings disposed symmetrically relative to the axis of rotation, a conically shaped section on the entire lateral slide surfaces, and is used in a valve apparatus like that in claim 2.

* * * * *